US011843194B2

(12) United States Patent
Jo et al.

(10) Patent No.: US 11,843,194 B2
(45) Date of Patent: Dec. 12, 2023

(54) TERMINAL-EQUIPPED ELECTRIC WIRE

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP); TOYOTA JIDOSHA KABUSHIKI KAISHA, Toyota (JP)

(72) Inventors: Takahito Jo, Yokkaichi (JP); Yasushi Saito, Yokkaichi (JP); Tomoyuki Sakata, Yokkaichi (JP); Masaaki Tabata, Yokkaichi (JP); Teruo Hara, Yokkaichi (JP); Shunya Takeuchi, Yokkaichi (JP); Hideki Matsunaga, Yokkaichi (JP); Keisuke Teramoto, Yokkaichi (JP); Hiroshi Kobayashi, Toyota (JP); Takeshi Amakawa, Toyota (JP)

(73) Assignees: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 47 days.

(21) Appl. No.: 17/628,972

(22) PCT Filed: Aug. 5, 2020

(86) PCT No.: PCT/JP2020/030054
§ 371 (c)(1),
(2) Date: Jan. 21, 2022

(87) PCT Pub. No.: WO2021/029302
PCT Pub. Date: Feb. 18, 2021

(65) Prior Publication Data

US 2022/0263261 A1 Aug. 18, 2022

(30) Foreign Application Priority Data

Aug. 9, 2019 (JP) ..... 2019-147255

(51) Int. Cl.
*H01R 13/03* (2006.01)
*H01R 4/50* (2006.01)
(Continued)

(52) U.S. Cl.
CPC ..... *H01R 13/03* (2013.01); *H01R 4/50* (2013.01); *H01R 13/11* (2013.01); *H01R 13/193* (2013.01); *H01R 4/18* (2013.01)

(58) Field of Classification Search
None
See application file for complete search history.

(56) References Cited

U.S. PATENT DOCUMENTS 2,959,766 A 11/1960 Jacobsen
4,413,872 A 11/1983 Rudy, Jr. et al.
(Continued)

FOREIGN PATENT DOCUMENTS

CN 1203467 A 12/1998
CN 106464094 A 2/2017
(Continued)

OTHER PUBLICATIONS

Wire-Breaking-Point Value Measured Easily and Accurately, Automatic Pull Tester, APT1000, APT500, APT250, Automatic Pull Force Tester for Crimped Cables, Mar. 9, 2016, url:https://premium.ipros.jp/truesoltec/catalog/detail/334223.
(Continued)

*Primary Examiner* — Ross N Gushi
(74) *Attorney, Agent, or Firm* — Oliff PLC

(57) ABSTRACT

A terminal-equipped electric wire includes an electric wire that includes a conductor, a terminal connected to the conductor, and a shell attached to the terminal. The conductor has a nominal cross-sectional area of 0.13 $mm^2$ or less. The terminal includes a grip portion that pinches the conductor. The shell includes a pressing portion that presses at least a portion of the grip portion toward the conductor. At
(Continued)

least one of the conductor and the grip portion includes a tin layer, and an oxide coating formed on the surface of the tin layer. An adhering portion formed of a portion of tin contained in the tin layer that passes through the oxide coating and pours out onto a surface of the oxide coating. The adhering portion has an area of 0.100 $mm^2$ or more.

6 Claims, 13 Drawing Sheets

(51) Int. Cl.

| | |
|---|---|
| ***H01R 13/11*** | (2006.01) |
| ***H01R 13/193*** | (2006.01) |
| *H01R 4/18* | (2006.01) |

(56) References Cited

U.S. PATENT DOCUMENTS

| | | | |
|---|---|---|---|
| 4,568,138 | A | 2/1986 | McKenzie |
| 4,597,622 | A | 7/1986 | Coe |
| 5,924,887 | A | 7/1999 | Aoyama et al. |
| 6,089,930 | A | 7/2000 | Matsuoka et al. |
| 6,435,899 | B2 | 8/2002 | Kojima |
| 6,729,895 | B1 | 5/2004 | Bryan |
| 8,342,868 | B2 | 1/2013 | Puettner et al. |
| 9,817,030 | B2 | 11/2017 | Chang |
| 10,446,293 | B2 | 10/2019 | Uegaki et al. |
| 10,505,290 | B2 | 12/2019 | Kuroiwa et al. |
| 10,553,329 | B2 | 2/2020 | Uegaki et al. |
| 10,855,017 | B2 | 12/2020 | Nakazono et al. |
| 11,062,822 | B2 | 7/2021 | Uegaki et al. |
| 11,069,459 | B2 | 7/2021 | Kobayashi et al. |
| 2005/0118858 | A1 | 6/2005 | Matsui et al. |
| 2006/0166547 | A1 | 7/2006 | Deutmarg et al. |
| 2008/0090096 | A1 | 4/2008 | Suzuki et al. |
| 2009/0318002 | A1 | 12/2009 | Murano et al. |
| 2010/0197179 | A1 | 8/2010 | Miyamoto et al. |
| 2011/0020664 | A1 | 1/2011 | Mitose et al. |
| 2013/0092437 | A1 | 4/2013 | Yoshinaga |
| 2015/0357723 | A1 | 12/2015 | Tachibana et al. |
| 2015/0357724 | A1 | 12/2015 | Okuno et al. |
| 2015/0357725 | A1 | 12/2015 | Matsuo et al. |
| 2016/0190712 | A1 | 6/2016 | Hirooka et al. |
| 2017/0033486 | A1 | 2/2017 | Saka et al. |
| 2017/0085047 | A1 | 3/2017 | Noguchi |
| 2019/0106801 | A1 | 4/2019 | Nishida et al. |
| 2019/0280402 | A1 | 9/2019 | Matsuo et al. |
| 2019/0305440 | A1 | 10/2019 | Shinohara |
| 2020/0076103 | A1 | 3/2020 | Narieda et al. |
| 2020/0169020 | A1 | 5/2020 | Nozaki et al. |
| 2020/0194907 | A1 | 6/2020 | Washio et al. |
| 2020/0243995 | A1 | 7/2020 | Kodama et al. |
| 2020/0266556 | A1 | 8/2020 | Takeuchi et al. |
| 2020/0350708 | A1 | 11/2020 | Hasui et al. |
| 2020/0395688 | A1 | 12/2020 | Tamura et al. |
| 2021/0044045 | A1 | 2/2021 | Shirai et al. |
| 2021/0134483 | A1 | 5/2021 | Kobayashi et al. |
| 2022/0255245 | A1 | 8/2022 | Jo et al. |
| 2022/0271448 | A1 | 8/2022 | Jo et al. |
| 2022/0311168 | A1 | 9/2022 | Tazawa et al. |
| 2022/0352665 | A1 | 11/2022 | Jo et al. |
| 2022/0380924 | A1 | 12/2022 | Miyashima et al. |

FOREIGN PATENT DOCUMENTS

| | | | |
|---|---|---|---|
| DE | 20 2016 104726 | U1 | 8/2017 |
| JP | 2004-179055 | A | 6/2004 |
| JP | 2006-183068 | A | 7/2006 |
| JP | 2009-247160 | A | 10/2009 |
| JP | 2010-262863 | A | 11/2010 |
| JP | 2012-028057 | A | 2/2012 |
| JP | 2017-220392 | A | 12/2017 |
| JP | 2018-190533 | A | 11/2018 |
| JP | 2019-021405 | A | 2/2019 |
| JP | 2019-079674 | A | 5/2019 |
| WO | 2003/036762 | A2 | 5/2003 |

OTHER PUBLICATIONS

Nov. 17, 2020 International Search Report issued in International Patent Application No. PCT/JP2020/030055.

Oct. 6, 2020 International Search Report issued in International Patent Application No. PCT/JP2020/030053.

Oct. 6, 2020 International Search Report issued in International Patent Application No. PCT/JP2020/030054.

U.S. Appl. No. 17/629,265, filed Jan. 21, 2022 in the name of Takahito Jo et al.

U.S. Appl. No. 17/629,159, filed Jan. 21, 2022 in the name of Takahito Jo et al.

Apr. 4, 2023, Office Action issued in U.S. Appl. No. 17/629,159.

Apr. 28, 2023 Patent Office Communication issued in U.S. Appl. No. 17/629,159.

Jul. 19, 2023 Notice of Allowance issued in U.S. Appl. No. 17/629,159.

TERMINAL-EQUIPPED ELECTRIC WIRE

TECHNICAL FIELD

The present disclosure relates to a terminal-equipped electric wire.

The present application claims priority based on Japanese Patent Application No. 2019-147255 filed on Aug. 9, 2019, the entire contents of which are incorporated herein by reference.

BACKGROUND ART

Terminal-equipped electric wires for transmitting signals are used in moving bodies such as automobiles. Each terminal-equipped electric wire includes an electric wire that has a conductor, and a terminal that is electrically connected to the conductor.

The conductor of the electric wire and the terminal are often connected to each other through crimping. For example, the terminal disclosed in Patent Document 1 includes an open-barrel-shaped crimp portion (wire barrel) to be crimped to a conductor. In this configuration, the conductor and the terminal are mechanically and electrically connected to each other by disposing the conductor inside the wire barrel and crimping the wire barrel.

CITATION LIST

Patent Documents

Patent Document 1: JP 2019-21405A

SUMMARY OF INVENTION

A terminal-equipped electric wire of the present disclosure includes:

- an electric wire that includes a conductor;
- a terminal connected to the conductor; and
- a shell attached to the terminal,
- in which the conductor has a nominal cross-sectional area of 0.13 $mm^2$ or less,
- the terminal includes a grip portion that pinches the conductor,
- the shell includes a pressing portion that presses at least a portion of the grip portion toward the conductor,
- at least one of the conductor and the grip portion includes:
  - a tin layer;
  - an oxide coating formed on a surface of the tin layer; and
  - an adhering portion formed of a portion of tin contained in the tin layer that passes through the oxide coating and pours out onto a surface of the oxide coating, and
- the adhering portion has an area of 0.100 $mm^2$ or more.

DESCRIPTION OF EMBODIMENTS

Figure 1:
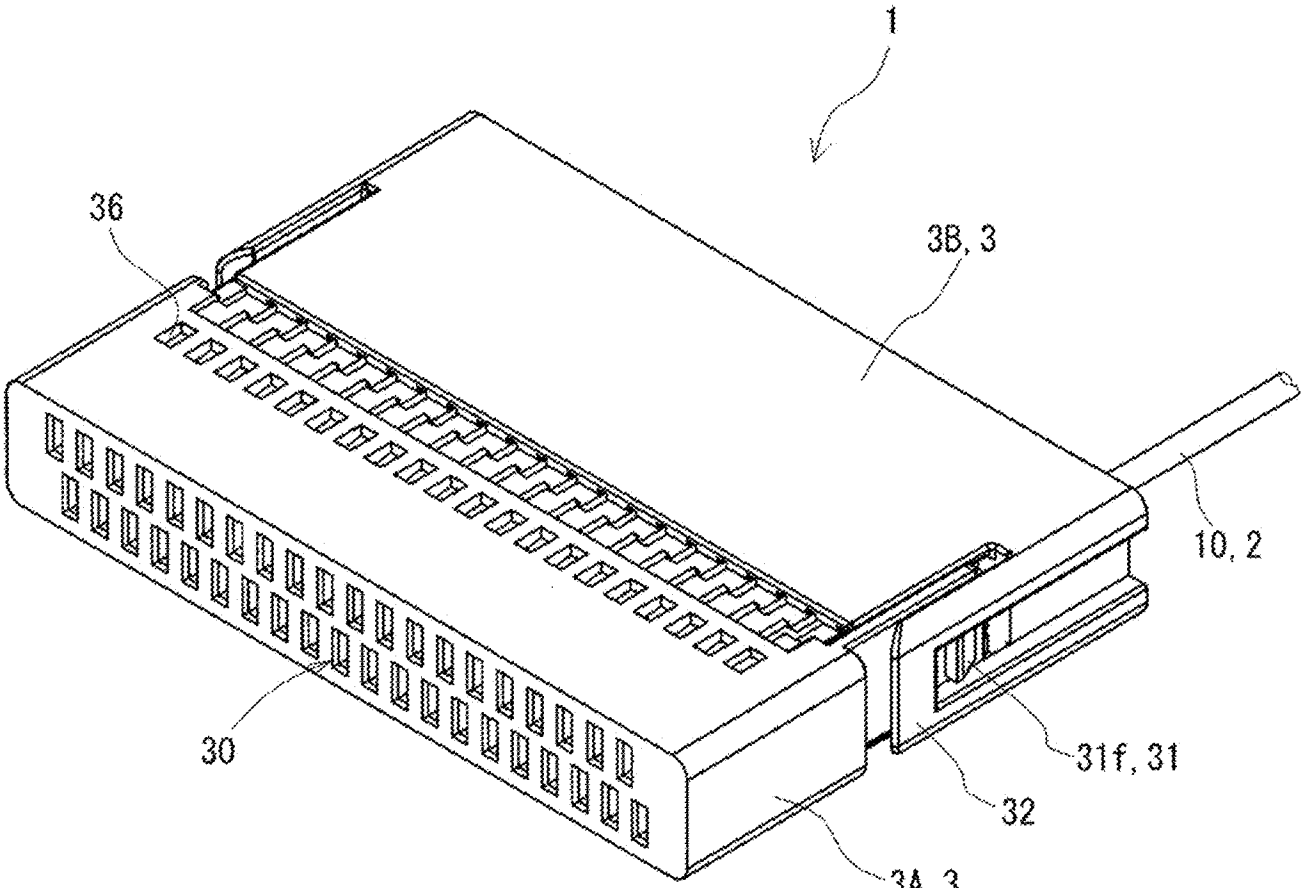
FIG. 1 is a schematic configuration diagram of a connector assembly described in Embodiment 1.

Problem to be Solved by the Present Disclosure

Recent years have seen automobiles being equipped with more electric components, and as a result, the number of terminal-equipped electric wires mounted in the automobiles is on the rise. Accordingly, there is a tendency for the size of a connector for assembling a plurality of terminal-equipped electric wires to be increased. There is a limit on the size of a space in which the connector is to be mounted, and therefore, there is a need to reduce the size of the connector as much as possible.

Attempts have been made to reduce the diameter of the electric wire included in the terminal-equipped electric wire in order to reduce the size of the connector. In this case, it is important to ensure the strength of connection between the conductor of the electric wire and the terminal. The reason for this is that a connection portion where the conductor of the electric wire and the terminal are connected to each other vibrates, particularly in automobiles and the like.

In view of this, it is an object of the present disclosure to provide a terminal-equipped electric wire in which the strength of connection between the conductor of the electric wire and the terminal is excellent.

Effects of the Present Disclosure

With a terminal-equipped electric wire of the present disclosure, the strength of connection between the conductor of the electric wire and the terminal is excellent.

Description of Embodiment of the Present Disclosure

The inventors of the present invention intensively investigated a configuration in which the strength of connection between the conductor of the electric wire and the terminal is improved. As a result, it was revealed that, when a configuration was employed in which the conductor or the terminal was provided with a tin (Sn) layer, and the conductor could be continuously pinched with a strong force, connection strength greater than that obtained in a configuration in which a conductor was merely pinched was obtained. It was also found that a Sn adhering portion was formed at the boundary between the conductor and the terminal by continuously pinching the conductor with a strong force using the terminal. The inventors of the present invention achieved the terminal-equipped electric wire of the present disclosure based on these findings. Firstly, embodiments for carrying out the present disclosure will be listed and described.

(1) A terminal-equipped electric wire according to an aspect includes:

an electric wire that includes a conductor;

a terminal connected to the conductor; and a shell attached to the terminal, in which the conductor has a nominal cross-sectional area of 0.13 $mm^2$ or less, the terminal includes a grip portion that pinches the conductor, the shell includes a pressing portion that presses at least a portion of the grip portion toward the conductor, at least one of the conductor and the grip portion includes:

a tin layer;

an oxide coating formed on a surface of the tin layer; and an adhering portion formed of a portion of tin contained in the tin layer that passes through the oxide coating and pours out onto a surface of the oxide coating, and the adhering portion has an area of 0.100 $mm^2$ or more.

With the above-mentioned configuration, the grip portion of the terminal is continuously pressed against the conductor by the pressing portion of the shell. Accordingly, the tin adhering portion is formed between the conductor and the grip. The tin adhering portion is formed of a portion of the tin layer provided on the terminal or grip portion that pours out onto the surface of the oxide coating of the tin layer. This adhering portion firmly joins the grip portion and the conductor to each other. As a result, even if the electric wire included in the terminal-equipped electric wire according to the aspect is pulled, the conductor is unlikely to be detached from the terminal. A holding force that refers to a force with which the conductor is held in the terminal-equipped electric wire according to this aspect is greater than that in a conventional terminal-equipped electric wire which includes a wire barrel for holding an electric wire.

(2) In an embodiment of the terminal-equipped electric wire according to the aspect, the terminal includes the tin layer, and the adhering portion adheres to the conductor.

It is easier to provide the tin layer on the terminal than on the elongated conductor. Moreover, the amount of tin used can be reduced by providing the tin layer on the terminal rather than on the elongated conductor. If the amount of tin used is small, an increase in the weight of a terminal-equipped electric wire and an increase in the production cost thereof can be reduced.

(3) In an embodiment of the terminal-equipped electric wire according to the aspect, the conductor is a single-core wire.

When a conductor constituted by a plurality of core wires is pinched by the grip portion, the core wires are likely to move. On the other hand, when pinched by the grip portion, a conductor constituted by a single-core wire is unlikely to move. Accordingly, the conductor constituted by a single-core wire is firmly pinched by the grip portion.

(4) In an embodiment of the terminal-equipped electric wire according to the aspect, the conductor is made of a Cu—Sn alloy or a Cu—Ag alloy.

The Cu—Sn alloy is firmly fixed to the terminal. The Cu—Ag alloy has excellent strength and is highly suited for use in vehicles.

(5) In an embodiment of the terminal-equipped electric wire according to the aspect, the shell includes:

a tubular portion in which the grip portion is housed; and the pressing portion formed in the tubular portion.

The shell formed in a tubular shape is unlikely to deform. Accordingly, a force with which the grip portion of the terminal pinches the conductor is likely to be maintained for a long period of time due to the tubular shell.

(6) In an embodiment of the terminal-equipped electric wire according to (5) above, the grip portion includes a first plate-like piece and a second plate-like piece that are opposed to each other with the conductor being located therebetween, the pressing portion includes a first protruding portion and a second protruding portion that protrude toward an inner side of the tubular portion, the first protruding portion presses the first plate-like piece toward the second plate-like piece, and the second protruding portion presses the second plate-like piece toward the first plate-like piece.

With the above-mentioned configuration, the conductor is pinched between the first plate-like piece and the second plate-like piece included in the grip portion at positions on the outer circumferential surface of the conductor that are symmetrical with respect to the center of the conductor. This makes it unlikely that the position of the conductor in the grip portion will change, and thus the conductor holding force of the grip portion is significantly improved. Also, with the above-mentioned configuration, the first protruding portion and the second protruding portion press the first plate-like piece and the second plate-like piece, respectively. Accordingly, the force with which the first plate-like piece presses the conductor and the force with which the second plate-like piece presses the conductor are likely to be balanced. This configuration is another reason why the conductor holding force of the grip portion is significantly improved.

Details of Embodiments of the Present Disclosure

Specific examples of a terminal-equipped electric wire according to an embodiment of the present disclosure will be described below with reference to the drawings. The same reference numerals in the diagrams denote components having the same name. The present invention is defined by the terms of the claims, but not limited to the above description, and is intended to include any modifications within the meaning and scope equivalent to the terms of the claims.

Embodiment 1

In Embodiment 1, a terminal-equipped electric wire 10 of this embodiment will be described using a connector assembly 1 shown in FIG. 1 as an example. The connector assembly 1 includes a plurality of terminal-equipped electric wires 10 and one connector 3. In FIG. 1, only one terminal-equipped electric wire 10 is shown for illustrative reasons. This terminal-equipped electric wire 10 includes an electric wire 2 and a terminal 4 (FIG. 6) attached to the leading end of the electric wire 2. The terminal 4 according to this embodiment is a female terminal. Accordingly, the connector 3 of this embodiment is a female connector. The terminal 4 may also be a male terminal unlike this embodiment.

Connector

Figure 2:
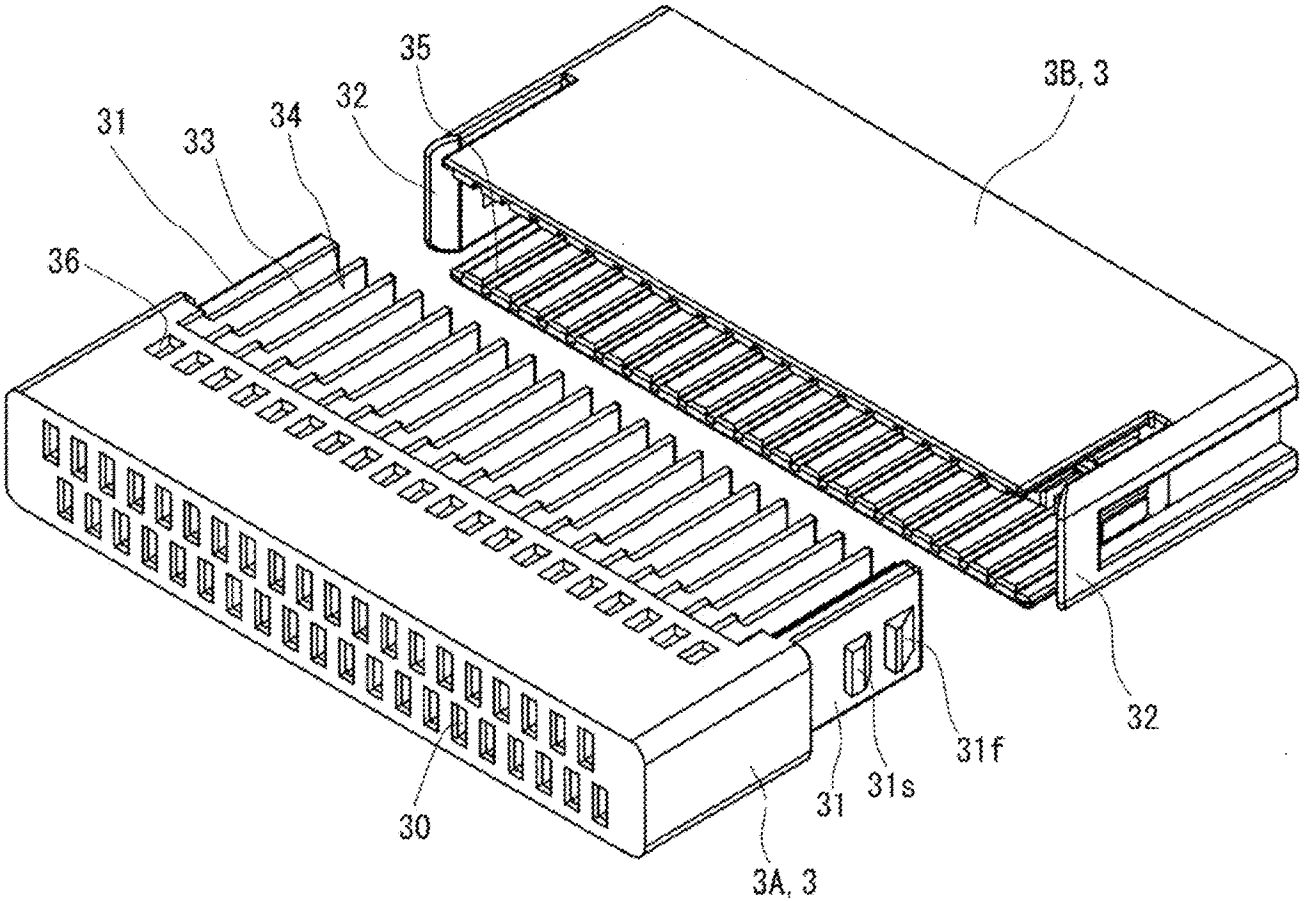
FIG. 2 is an exploded perspective view of a connector included in the connector assembly described in Embodiment 1.

A male connector (not illustrated) is to be fitted to the connector 3. As shown in FIG. 2, the connector 3 is formed by mechanically attaching a front housing 3A and a rear cover 3B to each other. The front housing 3A is provided with a plurality of insertion holes 30 into which the leading ends of male terminals of the male connector (not illustrated) are to be inserted. A plurality of cavities 34 that are divided by partition walls 33 are formed on a side opposite to the insertion holes 30 in the front housing 3A. The cavities 34 are respectively continuous with the insertion holes 30.

Electric wire insertion holes through which the electric wires 2 are to be inserted are formed in the rear end portion (not illustrated) of the rear cover 3B. A plurality of sliding grooves 35 are arranged on the front housing 3A side of the inner peripheral surface of the rear cover 3B. The partition walls 33 of the front housing 3A are slid into and fitted to the sliding grooves 35.

The front housing 3A and the rear cover 3B of this embodiment engage with each other using a two-step snap-fit structure. The snap-fit structure includes housing-side engagement portions 31 that are formed at the two end portions in the width direction of the front housing 3A, and cover-side engagement portions 32 that are formed at the two end portions in the width direction of the rear cover 3B. The housing-side engagement portions 31 are plate-like members provided at the two ends in the width direction of the front housing 3A. Each of the plate-like members is provided with a first protrusion 31*f* and a second protrusion 31*s* on a face on the outer side of the plate-like member. The first protrusion 31*f* is disposed closer to the rear end of the front housing 3A than the second protrusion 31*s* is. On the other hand, the cover-side engagement portions 32 are gate-shaped engagement pieces. Accordingly, when the rear cover 3B is fitted to the front housing 3A, the first protrusions 31*f* first engage with through holes of the cover-side engagement portions 32. When the rear cover 3B is further pushed into the front housing 3A, the cover-side engagement portions 32 move over the first protrusions 31*f*, and then the second protrusions 31*s* engage with the through holes of the cover-side engagement portions 32.

Electric Wire

Figure 6:
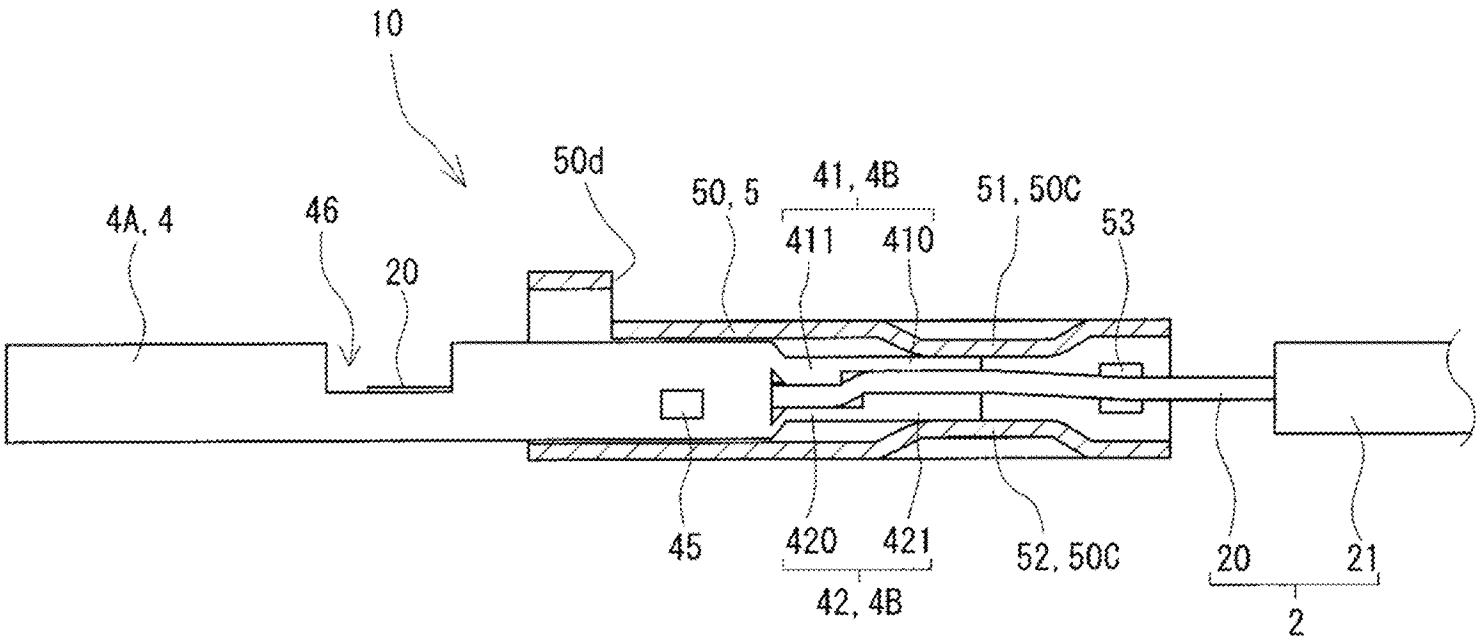
FIG. 6 is a longitudinal partial cross-sectional view of a terminal-equipped electric wire described in Embodiment 1.

As shown in FIG. 6, the electric wire 2 includes a conductor 20 and an insulating layer 21 formed on the outer circumference of the conductor 20. The insulating layer 21 is peeled off at an end portion of the electric wire 2, and thus the conductor 20 is exposed. The exposed conductor 20 is mechanically and electrically connected to the terminal 4, which will be described later.

The conductor 20 may be a single-core wire or a twisted wire. The conductor 20 of this embodiment is a single-core wire. The nominal cross-sectional area of the single-core wire is not particularly limited, but is, for example, 0.13 $mm^2$ or less. An example of a thinner single-core wire is a single-core wire having a nominal cross-sectional area of 0.05 $mm^2$. The conductor 20 employed in the terminal-equipped electric wire 10 according to the embodiment of the present disclosure is thinner compared with a conventional terminal-equipped electric wire. Even with the structure of the terminal-equipped electric wire 10 according to the embodiment, the terminal 4 can firmly hold such a thin conductor 20. The reason for this is that, as described later, the conductor 20 and the terminal 4 are adhered to each other due to Sn.

The conductor 20 not yet connected to the terminal 4 has a portion containing at least copper (Cu). Examples of the material of the conductor 20 include Cu and Cu alloys. Examples of the Cu alloys include a Cu—Ag alloy, a Cu—Sn alloy, and a Cu—Fe alloy. The Cu—Sn alloy is firmly fixed to the terminal. The Cu—Ag alloy has excellent strength and is highly suited for use in vehicles. A tin (Sn) layer may be formed on the outermost surface of the conductor 20 not yet connected to the terminal 4. On the other hand, the insulating layer 21 is formed using an insulating resin such as polyvinyl chloride or polyethylene.

Terminal

Figure 3:
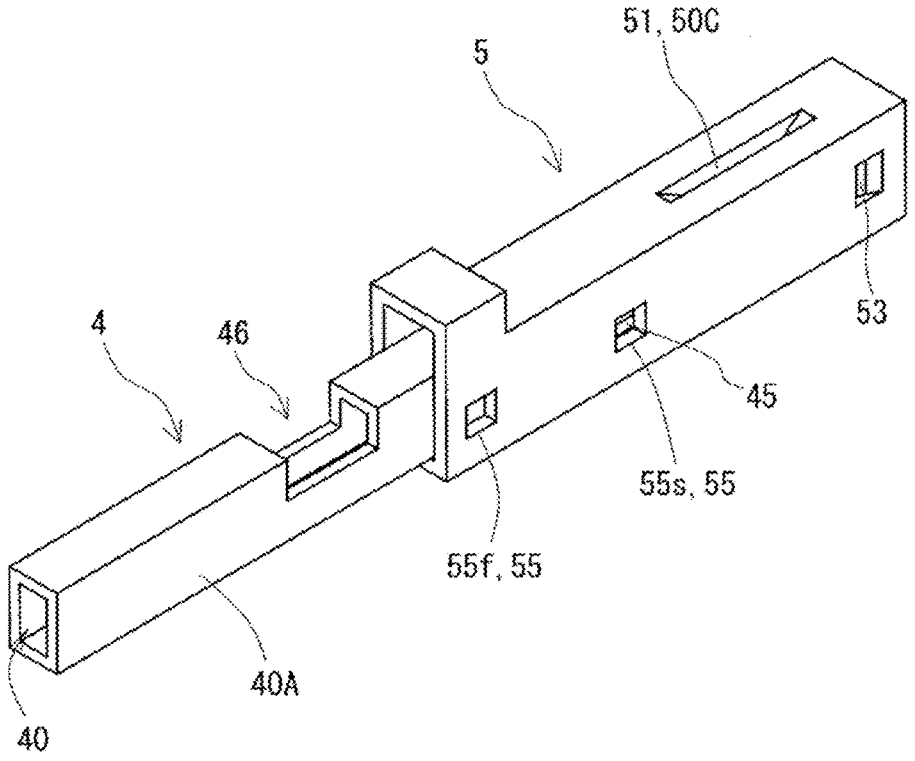
FIG. 3 is a schematic perspective view of an assembly of a terminal and a shell described in Embodiment 1.

The terminal 4 is used in combination with a shell 5 to be attached to the terminal 4 (FIG. 3). The terminal 4 of this embodiment is obtained by press-molding one sheet of a plate material. When the conductor 20 has a nominal cross-sectional area of 0.13 $mm^2$, the thickness of the plate material is preferably 0.05 mm or more and 0.20 mm or less. If the thickness of the plate material is 0.05 mm or more, the mechanical strength of the terminal 4 can be ensured. If the thickness of the plate material is 0.20 mm or less, an increase in size of the terminal 4 is avoided. The thickness of the plate material is more preferably 0.1 mm or more and 0.15 mm or less.

The terminal 4 not yet connected to the conductor 20 includes a base material having excellent electrical conductivity, and a Sn layer formed on the outermost surface of the base material. Examples of the base material include Cu and Cu alloys. The outermost surface is plated with, for example, Sn, Ag, or the like. Ni (nickel) or a Ni alloy may be plated as a base plating.

Figure 4:
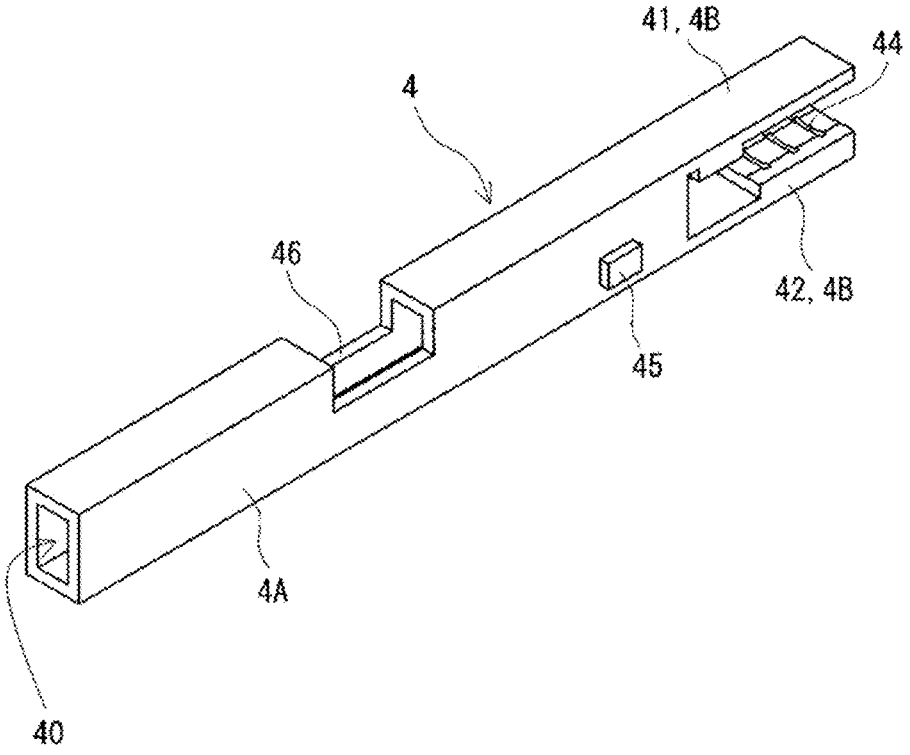
FIG. 4 is a schematic perspective view of the terminal described in Embodiment 1.

As shown in FIG. 4, the terminal 4 includes a terminal connection portion 4A formed in a tubular shape, and a grip portion 4B integrated with the rear end portion of the terminal connection portion 4A. The grip portion 4B is a portion of the terminal 4 that is electrically connected to the conductor 20.

The terminal connection portion 4A is provided with an insertion hole 40 formed at the leading end thereof. The terminal 4 is disposed inside the cavity 34 of the connector 3. Accordingly, the insertion hole 40 of the terminal 4 is disposed substantially coaxially with the insertion hole 30 of the connector 3.

The terminal connection portion 4A is provided with a through window 46 at an intermediate portion in the longitudinal direction thereof. The through window 46 is formed by cutting out a portion of the upper half of the terminal connection portion 4A. The through window 46 is located at a position corresponding to a through window 36 of the connector 3. Accordingly, when the terminal 4 is inserted into the cavity 34 of the connector 3, and the front end of the terminal 4 hits a step inside the cavity 34 and thus stops, the through window 46 of the terminal 4 is exposed inside the through window 36 of the connector 3. These through windows 36 and 46 are used to visually confirm, from the outside of the connector 3, whether or not the conductor 20 is inserted into the terminal 4.

Terminal-side engagement portions 45 are formed at positions close to the grip portion 4B on the side surfaces of the terminal connection portion 4A. Although only a terminal-side engagement portion 45 formed on one side surface is shown in FIG. 4, a terminal-side engagement portion 45 is also formed on the other side surface, which is located on the back side of the sheet of the diagram and cannot be seen. The terminal-side engagement portions 45 of this embodiment are protrusions that are to engage with shell-side engagement portions 55 of the shell 5, which will be described later.

The grip portion 4B of this embodiment includes a first plate-like piece 41 and a second plate-like piece 42 that are opposed to each other with the conductor 20 being located therebetween. The first plate-like piece 41 is formed integrally with the upper surface portion of the terminal connection portion 4A. The second plate-like piece 42 is formed integrally with the lower surface portion of the terminal connection portion 4A.

As shown in FIG. 6, the first plate-like piece 41 includes a first thin portion 410 and a first thick portion 411. In the first plate-like piece 41, the first thin portion 410 is located on the leading end side of the first plate-like piece 41 (the right side in the diagram), and the first thick portion 411 is located on the base side thereof (the left side in the diagram). In this embodiment, the first thick portion 411 is formed by stacking the plate material used in the terminal 4 one on top of the other (see FIG. 7). That is, the first thick portion 411 is about twice as thick as the first thin portion 410.

The second plate-like piece 42 includes a second thin portion 420 and a second thick portion 421. In the second plate-like piece 42, the second thin portion 420 is located on the base side, and the second thick portion 421 is located on the leading end side. The second thick portion 421 is formed by folding back the plate material used in the terminal 4. Accordingly, the thickness of the second thick portion 421 is substantially the same as the thickness of the first thick portion 411, and the thickness of the second thin portion 420 is substantially the same as the thickness of the first thin portion 410.

Recessed portions corresponding to the outer circumferential shape of the conductor 20 are provided on a surface on the second plate-like piece 42 side of the first thin portion 410 and a surface on the first plate-like piece 41 side of the second thick portion 421. As shown in FIG. 4, groove-like serrations 44 are formed in the recessed portions. The shape and number of serrations 44 are selected as appropriate. The serrations 44 of this embodiment are grooves with a V-shaped cross section. The number of serrations 44 is three.

As shown in FIG. 6, the first thick portion 411 and the second thick portion 421 are shifted relative to each other and do not overlap each other in the axial direction of the terminal 4 (in the left-right direction in the diagram). Accordingly, the conductor 20 pinched between the first plate-like piece 41 and the second plate-like piece 42 is bent at a position at which the first thick portion 411 and the second thick portion 421 are separated from each other in the longitudinal direction.

Shell

The shell 5 is a member for pressing the grip portion 4B of the terminal 4 toward the conductor 20 (FIG. 3). The shell 5 of this embodiment includes a tubular portion 50 to be fitted onto the rear end side of the terminal 4. The grip portion 4B of the terminal 4 is housed in the tubular portion 50. The tubular portion 50 is provided with a pressing portion 50C for pressing the grip portion 4B toward the conductor 20. As shown in FIG. 6, the pressing portion 50C of this embodiment includes a first protruding portion 51 and a second protruding portion 52. The two protruding portions 51 and 52 protrude toward the inner side of the tubular portion 50. The first protruding portion 51 of this embodiment is formed by recessing a portion of the upper surface portion of the tubular portion 50 toward the inner side of the tubular portion 50. The first protruding portion 51 presses the first plate-like piece 41 toward the second plate-like piece 42. On the other hand, the second protruding portion 52 is formed by recessing a portion of the lower surface portion of the tubular portion 50 toward the inner side of the tubular portion 50. The second protruding portion 52 presses the second plate-like piece 42 toward the first plate-like piece 41. The first protruding portion 51 and the second protruding portion 52 are opposed to each other.

The first plate-like piece 41 and the second plate-like piece 42 exert a pinch force onto the conductor 20 as a result of the tubular portion 50 being fitted around/onto the grip portion 4B from the outer circumferential side of the grip portion 4B. In view of this function, it is preferable to form the shell 5 using a high-strength material. For example, the shell 5 is made of SUS, steel, or the like. Instead, the shell 5 may also be made of a high-strength plastic.

Figure 5:
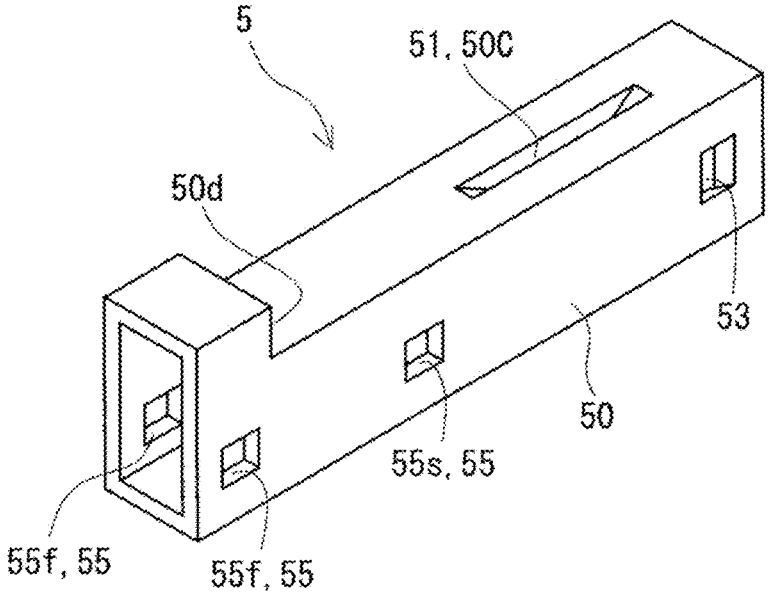
FIG. 5 is a schematic perspective view of the shell described in Embodiment 1.

As shown in FIG. 5, the tubular portion 50 includes a step portion 50*d* that is a portion protruding outward from the upper portion on the leading end side of the tubular portion 50. When the shell 5 is attached to the terminal 4, the rear cover 3B of the connector 3 presses the step portion 50*d*.

Shell-side engagement portions 55 are formed on the side surfaces of the tubular portion 50. The shell-side engagement portions 55 include first engagement portions 55*f* and second engagement portions 55*s*. The first engagement portions 55*f* and the second engagement portions 55*s* are rectangular through holes that pass through the tubular portion 50 and through which the inside and the outside of the tubular portion 50 are in communication with each other. The first engagement portions 55*f* are formed on the leading end side of the tubular portion 50, and the second engagement portions 55*s* are formed at an intermediate portion of the tubular portion 50. Accordingly, when the shell 5 is attached to the terminal 4, the terminal-side engagement portions 45 provided on the terminal 4 first engage with the first engagement portions 55*f*. In this engagement state, the grip portion 4B of the terminal 4 and the pressing portion 50C of the shell 5 are shifted relative to each other in the longitudinal direction of the terminal 4. When the shell 5 is further pushed toward the terminal 4, the terminal-side engagement portions 45 disengage from the first engagement portions 55*f* and engage with the second engagement portions 55*s*. In this engagement state, the pressing portion 50C is disposed at a position that overlaps the grip portion 4B in the longitudinal direction of the terminal 4, and the pressing portion 50C presses the grip portion 4B.

Guide portions 53 are formed in the side walls at the rear end side of the tubular portion 50. The guide portions 53 are formed by recessing portions of the side walls of the tubular portion 50 toward the inner side of the tubular portion 50. As shown in FIG. 6, the conductor 20 is sandwiched between the guide portions 53 in the width direction of the shell 5 (in the front-back direction of the sheet of FIG. 6). Accordingly, the conductor 20 is disposed at the center in the width direction of the shell 5, namely the center in the width direction of the terminal 4, by the guide portions 53.

An example of a shell having a structure different from that of this embodiment is a connector module in which the terminals 4 are individually housed. The connector module includes module housings that each can house only one terminal 4, and a module cover that covers the opening portions of the module housings. In this case, it is sufficient that the module housings and the module cover are each provided with a pressing portion.

Assemble Process

An example of a process for assembling the connector assembly 1 having the above-mentioned configuration will be described. First, the shell 5 is attached to the terminal 4 from the rear end portion thereof, and then the terminal-side engagement portions 45 engage with the first engagement portions 55*f* of the shell-side engagement portions 55. At this stage, the grip portion 4B of the terminal 4 and the pressing portion 50C of the shell 5 are shifted relative to each other in the longitudinal direction of the terminal 4, and the pressing portion 50C does not press the grip portion 4B. This assembly of the terminal 4 and the shell 5 is inserted into the cavity 34 of the front housing 3A of the connector 3, the rear cover 3B is attached to the front housing 3A from the rear end portion thereof, and then the housing-side engagement portions 31 engage with the first protrusions 31*f* of the cover-side engagement portions 32. At this time, the rear cover 3B pushes the step portion 50*d* of the shell 5, and thus the terminal 4 pushed by the shell 5 is disposed at a predetermined position in the connector 3.

Subsequently, the electric wire 2 is inserted from the rear end side of the rear cover 3B. At this time, the electric wire 2 is inserted until the conductor 20 can be seen through the through window 36 of the front housing 3A. When the conductor 20 can be seen through the through window 36, the rear cover 3B is further pushed toward the front housing 3A, and then the cover-side engagement portions 32 engage with the second protrusions 31*s*. At this time, the rear cover 3B pushes the step portion 50*d* of the shell 5, and the terminal-side engagement portions 45 engage with the second engagement portions 55*s* instead of the first engagement portions 55*f*. As a result, the first protruding portion 51 and the second protruding portion 52 of the shell 5 are disposed at positions corresponding to the first plate-like piece 41 and the second plate-like piece 42 of the terminal 4, respectively, and the conductor 20 is pinched between the first plate-like piece 41 and the second plate-like piece 42. The shell 5 has a tubular shape, which is unlikely to deform, and therefore, the two plate-like pieces 41 and 42 are continuously pressed against the conductor 20 with a strong force.

Compressibility

Figure 7:
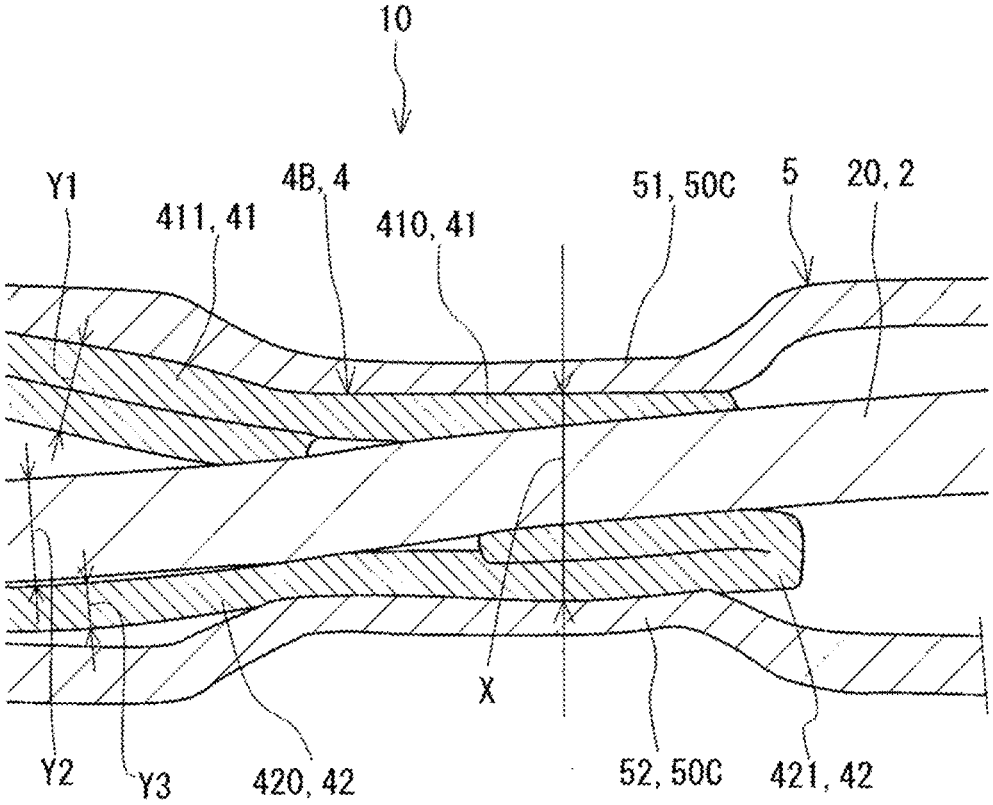
FIG. 7 is a schematic view of the vicinity of a pressing portion of the terminal-equipped electric wire in FIG. 6.

With the above-mentioned configuration, as shown in FIG. 7, the protruding portions 51 and 52 of the pressing portion 50C compress the plate-like pieces 41 and 42 of the grip portion 4B and the conductor 20. The total compressibility of the grip portion 4B and the conductor 20 that are compressed by the pressing portion 50C is preferably 5% or more and 50% or less. The total compressibility can be determined in accordance with the following formula regarding the longitudinal cross section of the terminal-equipped electric wire 10: $\{(Y-X)/Y\}\times 100$. X is the thickness of a portion that is compressed by the pressing portion 50C and is deformed, and Y is the thickness of a portion that is not compressed by the pressing portion 50C. The portion that is compressed and deformed includes both the grip portion 4B and the conductor 20. In the example shown in FIG. 7, a distance between the first protruding portion 51 and the second protruding portion 52 corresponds to the thickness X of the portion that is compressed and deformed. On the other hand, the thickness Y of the portion that is not compressed by the pressing portion 50C is the total thickness of portions that are not pinched between the first protruding portion 51 and the second protruding portion 52. For example, the thickness Y is a total value of a thickness Y1 of the first thick portion 411, a diameter Y2 of the conductor 20, and a thickness Y3 of the second thin portion 420. If the total compressibility is too large, the terminal 4 and the conductor 20 are likely to be damaged. If the total compressibility is too small, the force with which the terminal 4 holds the conductor 20 may decrease. The total compressibility is more preferably 10% or more and 30% or less.

Holding Force

With the terminal-equipped electric wire 10 of this embodiment, a holding force that refers to a force with which the grip portion 4B of the terminal 4 holds the conductor 20 significantly increases. The holding force can be evaluated using a testing device 7 shown in FIG. 8. The testing device 7 includes a pressing member 70 that abuts against the rear end surface of the shell 5, and a chuck 71 that catches onto the outer circumference of the electric wire 2. The pressing member 70 is fixed and is immovable. The chuck 71 is configured to be capable of moving toward a side away from the terminal 4 in the axial direction of the electric wire 2 (a side indicated by the solid-white arrow). The holding force is defined as the maximum load measured when such a testing device 7 is used as follows: the terminal 4 is fixed using the pressing member 70 and the electric wire 2 is pulled using the chuck 71 at a pulling speed of 50 mm/minute. The maximum load can be determined by continuously measuring the load required to move the chuck 71 at a constant speed. With the terminal-equipped electric wire 10 of this embodiment, this holding force is 20 N or more.

State of Joining Interface between Conductor and Terminal

Figure 9:
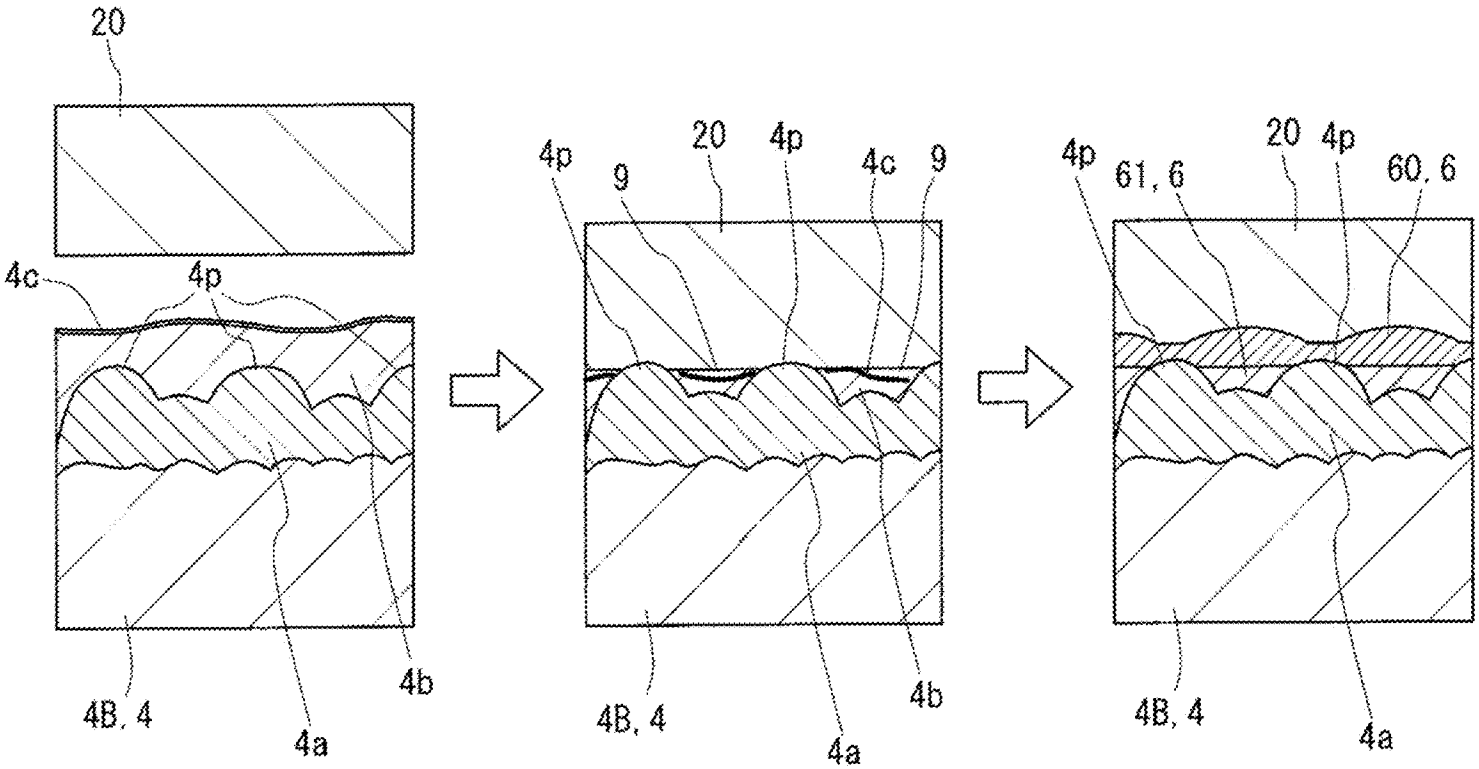
FIG. 9 is an explanatory diagram illustrating the alloying mechanism of the terminal-equipped electric wire described in Embodiment 1.

In the terminal-equipped electric wire 10 of this embodiment, an alloy layer is formed between the conductor 20 of the electric wire 2 and the grip portion 4B of the terminal 4. The alloy layer contains a Cu—Sn alloy obtained through alloying of Cu and Sn contained in at least one of the conductor 20 and the terminal 4. The reason why the alloy layer is formed between the conductor 20 and the grip portion 4B is that the grip portion 4B is continuously pressed against the conductor 20 with a strong force. A mechanism of the alloy layer formation will be described below with reference to FIG. 9. FIG. 9 shows a change in the state of the joining interface between the conductor 20 and the grip portion 4B over time in the order indicated by the solid-white arrows.

In the example shown in FIG. 9, the conductor 20 and the grip portion 4B of the terminal 4 are simplified into rectangular shapes. The left diagram in FIG. 9 shows the conductor 20 and the grip portion 4B not yet joined together, and the middle diagram shows a state immediately after the conductor 20 and the grip portion 4B have been joined together. The right diagram in FIG. 9 shows a state after a predetermined period of time has elapsed from when the conductor 20 and the grip portion 4B were joined together. The conductor 20 shown in the left diagram is made of a Cu—Ag alloy, and the grip portion 4B is obtained by forming a Sn layer 4*b* on the surface of a Ni base material. The Sn layer 4*b* is made of reflow Sn plating obtained by subjecting Sn plating to reflow processing. An oxide coating 4*c* formed through natural oxidation of Sn is formed on the surface of the Sn layer 4*b*. Moreover, a Sn—Ni alloy layer 4*a* formed through alloying of Sn of the Sn layer 4*b* and Ni is formed on the inner side of the Sn layer 4*b* by performing reflow processing. The surface of the Sn—Ni alloy layer 4*a* has an irregular shape that includes locally protruding protrusions 4*p*. Examples of the Sn—Ni alloy include $Ni_3Sn_4$ and the like. The hardness of the $Ni_3Sn_4$ is higher than the hardness of a Cu alloy used for the conductor 20.

As shown in the middle diagram in FIG. 9, when the conductor 20 and the grip portion 4B are pressed against each other with a strong force, the Sn oxide coating 4*c* formed on the surface of the Sn layer 4*b* is broken, and thus Sn pours out onto the surface of the oxide coating 4*c*. As a result, an adhering portion 9 where Sn adheres to the surface of the conductor 20 is formed, and thus the conductor 20 and the grip portion 4B are joined together. Moreover, the protrusions 4*p* formed on the Sn—Ni alloy layer 4*a* having high hardness bite into the conductor 20.

As shown in the right diagram in FIG. 9, an alloy layer 6 is formed between the conductor 20 and the grip portion 4B over time after the joining. The alloy layer 6 of this embodiment includes a Cu—Sn alloy layer 60 formed on the surface of the conductor 20, and a mixed layer 61. The Cu—Sn alloy layer 60 is formed through diffusion of Sn, which has adhered to the surface of the conductor 20 during the joining, to Cu of the conductor 20. The mixed layer 61 is formed between the Cu—Sn alloy layer 60 formed on the surface of the conductor 20 and the Sn—Ni alloy layer 4*a* formed on the surface of the grip portion 4B. The mixed layer 61 of this embodiment contains a Cu—Sn alloy and a Sn—Ni alloy. Examples of the Cu—Sn alloy include $Cu_6Sn_5$ and $Cu_3Sn$.

Test Example 1-1

Figure 8:
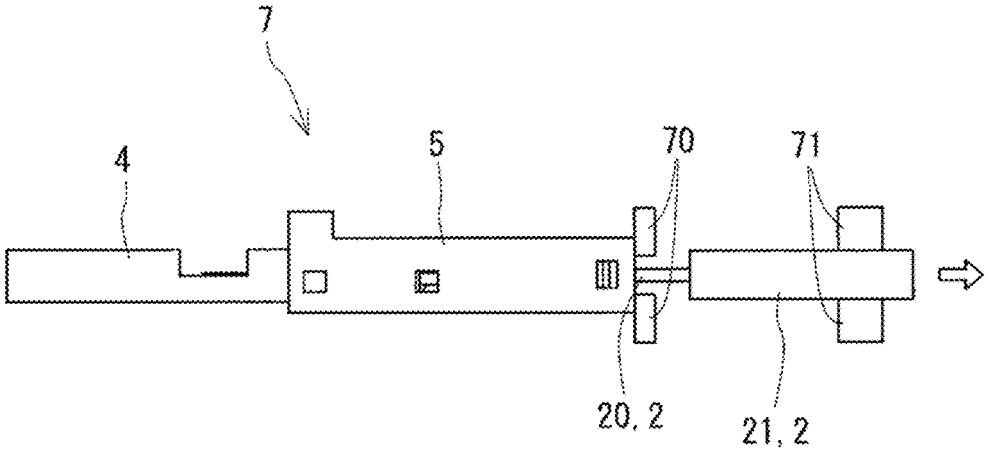
FIG. 8 is a schematic view of a device for measuring a conductor holding force of the terminal-equipped electric wire described in Embodiment 1.

In Test Example 1-1, the holding force, namely force with which the conductor 20 in the terminal-equipped electric wire 10 described in Embodiment 1 is held, was measured using the testing device 7 shown in FIG. 8.

First, a plurality of single-core wires made of a Cu—Ag alloy and a plurality of single-core wires made of a Cu—Ag alloy with a Sn plating layer were prepared as the conductors 20 of the electric wires 2. The conductors 20 had a nominal cross-sectional area of 0.13 $mm^2$. A plurality of terminals 4 obtained by applying Sn plating on the surface of a Ni base material and a plurality of shells 5 made of SUS were prepared. The plate materials used in the terminals 4 had a thickness of 0.1 mm. A plurality of samples of the terminal-equipped electric wire 10 were produced by assembling the conductor 20, the terminal 4, and the shell 5. Then, the holding force was measured at the following time points: immediately after the sample was produced; after the sample was left to stand at room temperature for 24 hours; after the sample was left to stand at room temperature for 120 hours; after the sample was left to stand at room temperature for 168 hours; and after the sample was kept at 120° C. for 120 hours. The heat treatment at 120° C. for 120 hours can be considered an accelerated test.

First, the longitudinal cross section of the sample of the terminal-equipped electric wire 10 was observed immediately after the sample was produced. The longitudinal cross section was as shown in the schematic diagram of FIG. 7. In the longitudinal cross section, the thickness (Y1+Y3) of the uncompressed grip portion 4B, the diameter Y2 of the uncompressed conductor 20, and the thickness X of the portion that was compressed by the pressing portion 50C were measured. As a result, the thickness Y1+Y3, the diameter Y2, and the thickness X were 315 μm, 250 μm, and 485 μm, respectively. Accordingly, the compressibility of this example was as follows: $\{(565-485)/565\}\times100=14.2\%$.

Next, the chuck 71 of the testing device 7 shown in FIG. 8 was pulled at a pulling speed of 50 mm/minute, and thus a load (N) required to move the chuck 71 at a constant speed was measured. This load can be considered as being the above-mentioned holding force. The results are collectively shown in the table in FIG. 10. The horizontal axes of the graphs in the table indicate the shift amount (mm) of the chuck 71, and the vertical axes indicate the holding force (N). As shown in the graphs in the table, in all of the samples, the holding force peaked at a shift amount of around 0.3 mm, a relatively high holding force was maintained between the shift amount at which the holding force peaked and a shift amount of about 4 mm, and then the holding force decreased to zero. Up until the holding force peaked, the shift amount of the chuck 71 resulted from the extension of the conductor 20, and the conductor 20 was not removed from the terminal 4. Accordingly, it is considered that the peak holding force corresponds to a static frictional force, and the off-peak holding force corresponds to a dynamic frictional force. The reason why the holding force decreased once at a shift amount of 3 mm to about 4 mm is that the leading end of the conductor 20 passed the position of the first thick portion 411 shown in FIG. 7, and the reason why the holding force finally decreased to zero is that the conductor 20 was removed from the terminal 4.

In all of the samples, the peak holding force was 20 N or more. Note that commercially distributed connector assemblies are not used immediately after produced, and therefore, the holding force in the sample measured immediately after the shell 5 has started to press the conductor 20 is practically negligible.

Figure 10:
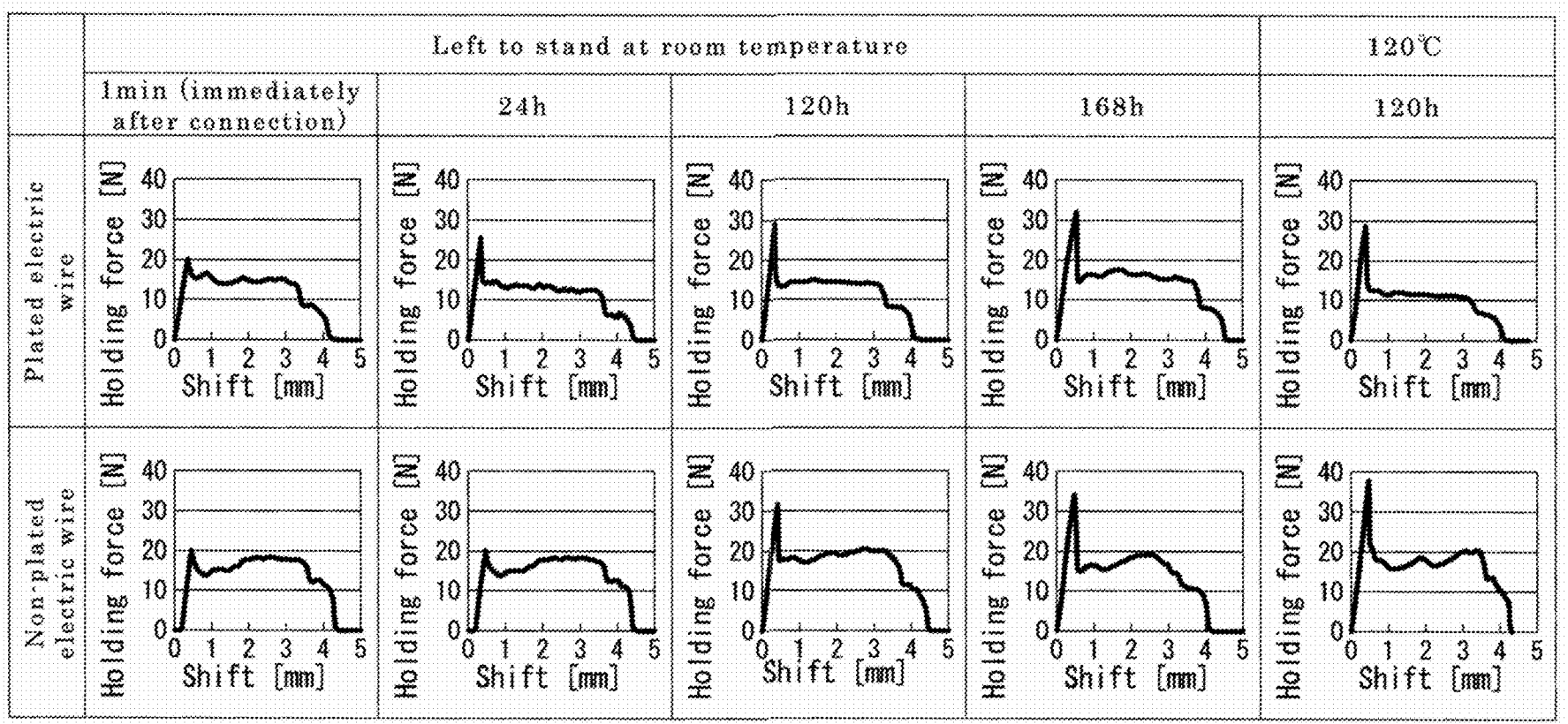
FIG. 10 is a diagram illustrating a table that collectively shows the test results of Test Example 1-1.

It was found from the results shown in FIG. 10 that the longer the time that had elapsed from when the sample production was, the higher the peak of the holding force tended to be. It is inferred from these results that some kind of change that causes an increase in the holding force occurs at the joining interface between the conductor 20 and the grip portion 4B of the terminal 4 over time. This point was investigated in Test Example 2-1, which will be described later.

Also, it was found that the off-peak holding force tended to be lower in the plated samples in which a Sn plating layer was provided on the surface of the conductor 20 compared with the non-plated samples in which a Sn plating layer was not provided on the surface of the conductor 20. The amount of pure Sn present between the conductor 20 and the grip portion 4B was smaller in the non-plated samples than in the plated samples. Pure Sn has a lubricating effect and is thus considered to reduce the dynamic frictional force between the conductor 20 and the grip portion 4B. Accordingly, it is inferred that the off-peak holding force in the non-plated samples was higher than the off-peak holding force in the plated samples.

Test Example 1-2

In Test Example 1-2, the same test as that in Test 1-1 was conducted using conductors 20 made of a Cu—Sn alloy that were not provided with a plating layer. The terminals 4 and the shells 5 were the same as those used in Test Example 1-1. The Cu—Sn alloy is softer than the Cu—Ag alloy used in Test Example 1-1. The holding force was measured at the following time points: immediately after the sample was produced; and after the sample was kept at 120° C. for 120 hours.

As results of the test, the holding force in the sample measured immediately after the sample production was 30.3

N, and the holding force in the sample subjected to the accelerated test was 32.1 N. It was found that, in the terminal-equipped electric wire 10 in which the soft conductor 20 made of a Cu—Sn alloy was used, the conductor 20 holding force was increased by pressing the conductor 20 with a strong force. It was confirmed that the above-mentioned holding force in the terminal-equipped electric wires 10 of Test Examples 1-1 and 1-2 was excellent, and thus the electrical connection reliability thereof was excellent.

Test Example 2-1

The following process was performed in order to investigate the reason why the static frictional force of the samples increased over time in Test Examples 1-1 and 1-2. First, terminal-equipped electric wires 10 were produced using the same conductors 20, terminals 4, and shells 5 as those used in Test Example 1-1. A Cu—Ag alloy provided with no plating layer was used for the conductors 20. Next, after a predetermined period of time had elapsed from when the terminal-equipped electric wires 10 were produced, the terminal-equipped electric wires 10 were disassembled, and the surfaces of the conductors 20 were observed under a SEM (Scanning Electron Microscope). The observation was conducted at the following time points: immediately after the grip portion 4B started to press the conductor 20 in the sample; after the sample was left to stand at room temperature for 120 hours; and after the sample was left to stand at 120° for 120 hours. The observation results are shown in the table in FIG. 11. Deposits were observed on the surfaces of the conductors 20 of the samples. It is inferred that these deposits are Sn adhering portions 9 (see FIG. 9) derived from the Sn layers 4*b* of the terminals 4.

Following the SEM results, the element distribution on the surface of the conductor 20 was investigated using EDX (Energy dispersive X-ray spectrometry). The results are shown in the table in FIG. 11. In the table, SEM images are shown in the first top row, the distributions of Sn adhering to the surfaces of the conductors are shown in the second top row, and the distributions of Cu on the surfaces of the conductors are shown in the third top row.

Figure 11:
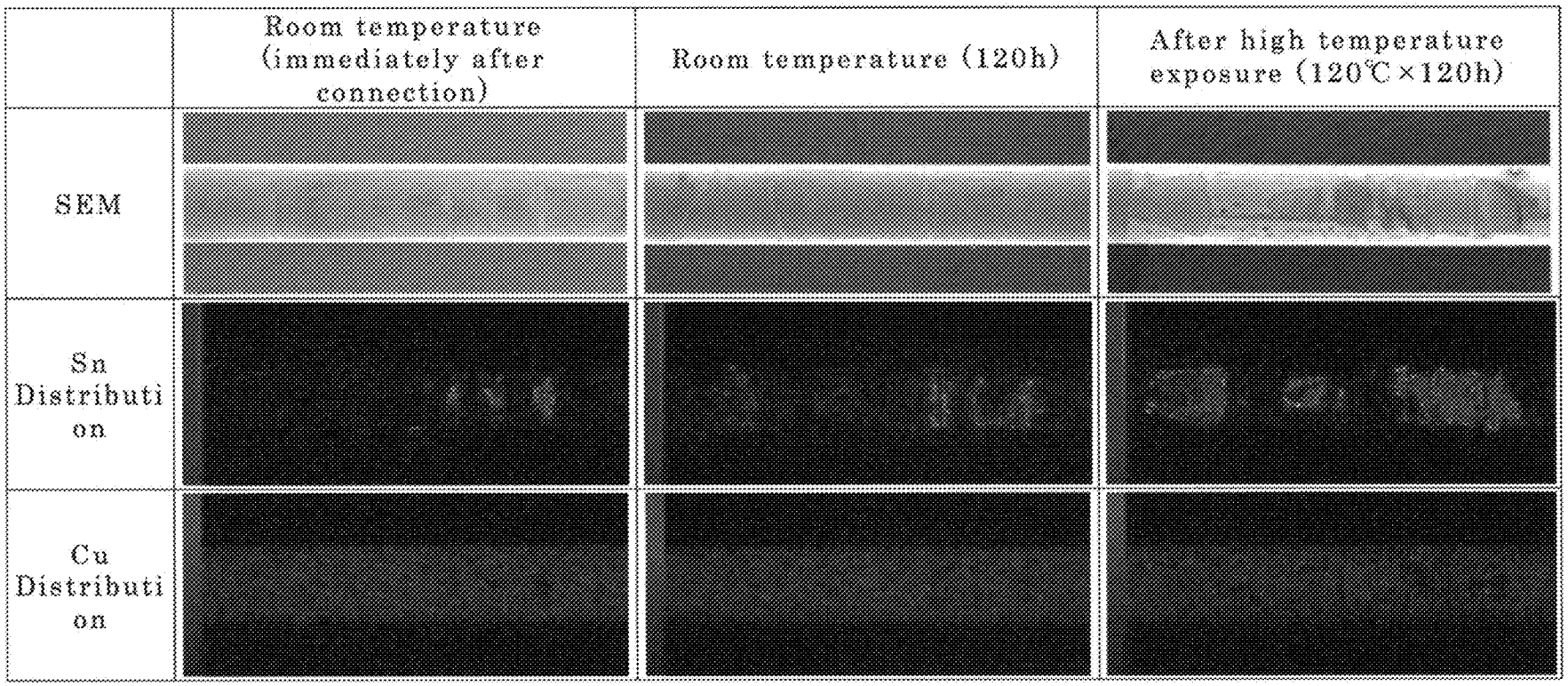
FIG. 11 is a diagram illustrating a table that collectively shows the test results of Test Example 2-1.

It was found from the results shown in FIG. 11 that Sn was widely distributed on the surface of the conductor 20 over time. Since the oxide coating 4*c* formed through natural oxidation is formed on the surface of the Sn layer 4*b* provided in the terminal 4, Sn in the Sn layer barely adheres to the surface of the conductor 20 by merely crimping the terminal 4 onto the conductor 20. On the other hand, in the samples of this example, the conductor 20 was continuously pinched between the first plate-like piece 41 and the second plate-like piece 42 of the terminal 4 with a strong force. Accordingly, it is considered that, in the samples of this example, Sn adhering to the surface of the conductor 20 corresponds to the adhering portion 9 formed of a portion of Sn contained in the Sn layers 4*b* on the plate-like pieces 41 and 42 that passes through the oxide coating 4*c* and pours out onto the surface of the conductor 20. Sn was widely distributed over time, and it is thus inferred that an increase in the area of the Sn adhering portion 9 improves the static frictional force in Tests 1-1 and 1-2.

Next, the area of the adhering portion 9 on the surface of the conductor 20 was calculated and determined. Specifically, the diameter of the conductor 20 was determined based on the SEM images shown in FIG. 11, and the view width (length in the same direction as the diameter) in which Cu was detected was determined based on the images showing the Cu distribution. In this example, the diameter was 267 μm, and the view width was 248 μm. The view width in which Cu is detected is a width in which elements can be analyzed using EDX. That is, elements can be analyzed in 93% of the area on the surface of the conductor 20. Portions in which elements cannot be analyzed are located at the ends of the conductor 20, and the plate-like pieces 41 and 42 provided with the Sn layer 4*b* are not in contact with these portions. Accordingly, the Sn distribution in the conductor 20 analyzed using EDX can be considered as the Sn distribution in the whole conductor 20. In view of this, the area of Sn in the view width was determined through image analysis. As a result, the areas of the Sn adhering portions 9 measured immediately after the sample was produced, after the sample was left to stand at room temperature for 120 hours, and after the sample was kept at 120° C. for 120 hours were 0.058 $mm^2$, 0.074 $mm^2$ and 0.119 $mm^2$, respectively. These measured areas are each an area on one side of the conductor 20. In each sample, the total area of the adhering portion 9 that includes the areas measured on two sides of the conductor 20 is approximately double the measured area. Although not shown in this specification, the adhering portion 9 was also formed on a side of the conductor 20 opposite to the side shown in FIG. 11 to the same extent as on the side shown in FIG. 11. That is, in the configuration in which the conductor 20 is continuously pinched between the two plate-like pieces 41 and 42 with a strong force, the area of the Sn adhering portion 9 on the surface of the conductor 20 was 0.100 $mm^2$ or more.

Test Example 2-2

Figure 12:
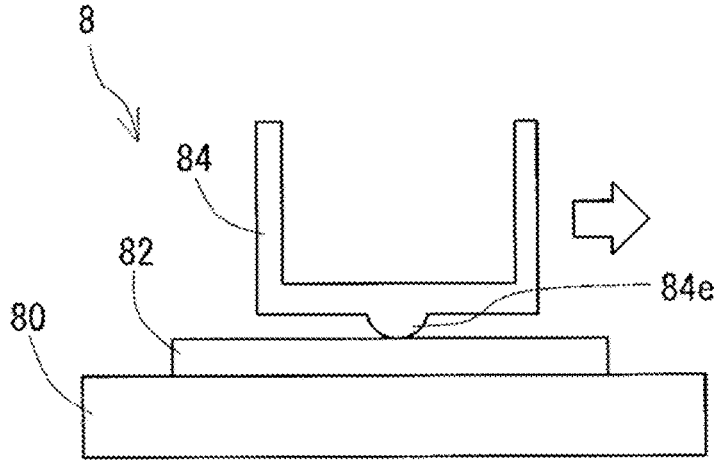
FIG. 12 is a schematic view of a testing device described in Test Example 2-2.

It is inferred from the results of Test Example 2-1 that the increase in the conductor 20 holding force caused by the grip portion 4B is caused by the adhesion of Sn. A test for examining the causal relation of the holding force and the adhesion of Sn was conducted using a testing device 8 shown in FIG. 12. The test was conducted at room temperature.

In the test conducted using the testing device 8, a plate material 82 made of Sn and a sliding member 84 made of Sn were first prepared. Next, the plate material 82 was placed on a base 80, and an embossing portion 84*e* of the sliding member 84 was pressed against the plate material 82. The radius of the embossing portion 84*e* was 1 mm. A vertical load of 1 N, 2 N, or 4 N was applied to the sliding member 84. The embossing portion 84*e* was pressed against the plate material 84 for 1 minute, 16 hours, or 64 hours. The longer the period of time over which the vertical load was applied to the sliding member 84 was, the greater the amount of Sn of the plate material 82 that adhered to the embossing portion 84*e* was.

After a predetermined period of time had elapsed, the sliding member 84 was moved in a horizontal direction while applying the vertical load to the sliding member 84. The force (N) required to move the sliding member 84 in the horizontal direction was measured as a frictional force, and a friction coefficient was determined by dividing the frictional force by the vertical load. Graphs indicating the relationship between the horizontal shift amount (mm) of the sliding member 84 and the friction coefficient are collectively shown in a table in FIG. 13. The horizontal axes of the graphs indicate the shift amount, and the vertical axes indicate the friction coefficient.

Figure 13:
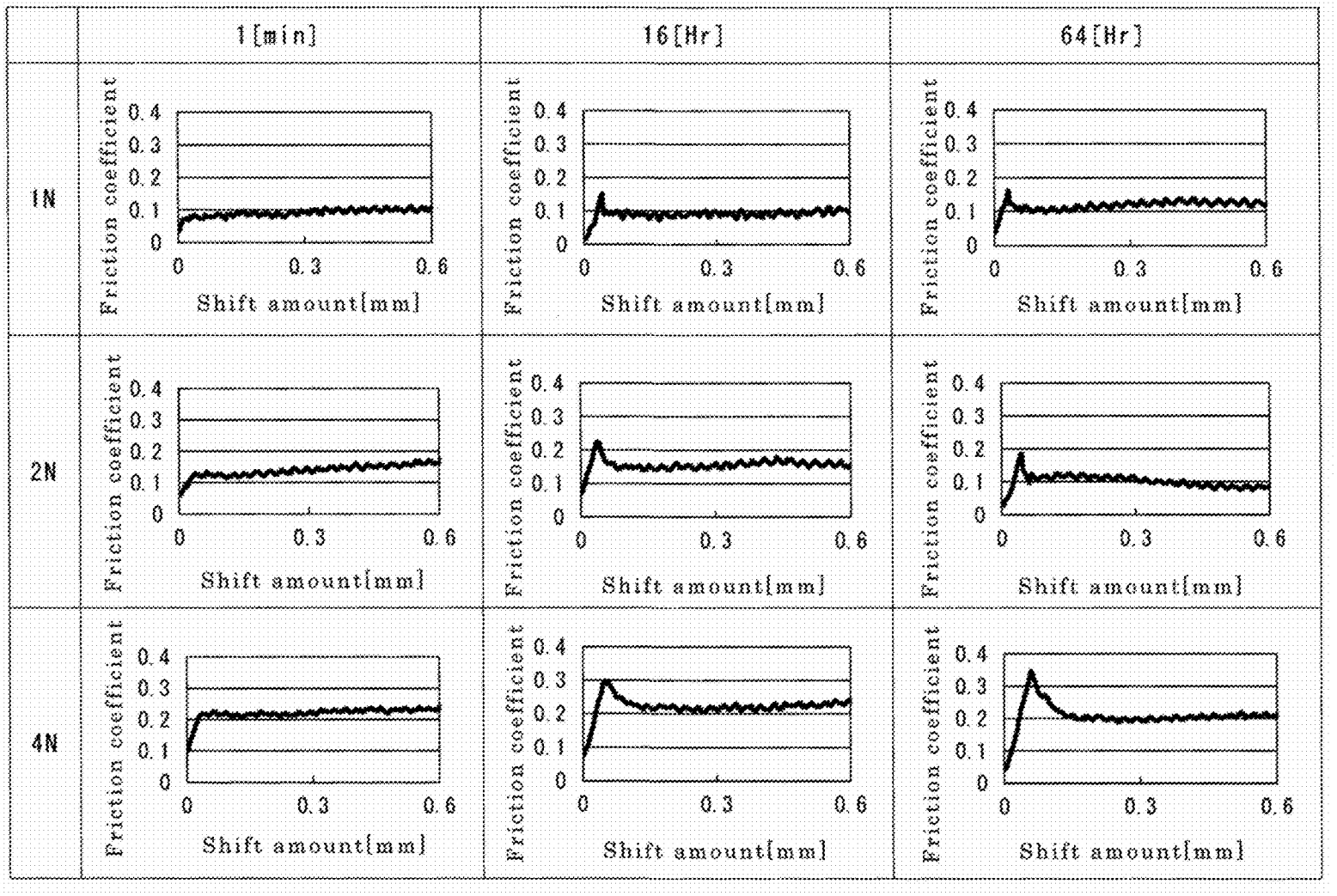
FIG. 13 is a table that collectively shows the test results of Test Example 2-2.

It was found from the results shown in FIG. 13 that the longer the period of time over which the vertical load was applied was, the higher the peak of the friction coefficient of the sliding member 84 was. The peak of the friction coefficient corresponds to the static friction coefficient. Since the test was conducted at room temperature, it is conceivable that the increase in the friction coefficient results from an increase in the amount of adhering Sn.

Also, it was found from the results shown in FIG. 13 that the greater the vertical load was, the higher the peak of the friction coefficient of the sliding member 84 was. That is, it was found that it is necessary to continuously press the grip portion 4B against the conductor 20 with a strong force in order to obtain a sufficient holding force in the terminal-equipped electric wire 10 shown in FIG. 6. A sufficient holding force cannot be obtained by merely pinching the conductor 20 using the grip portion 4B.

Test Example 3

Next, the state of the joining interface between the plate-like portion 41 or 42 of the grip portion 4B and the conductor 20 in each sample of Test Example 1-1 was examined using a SEM image. Also, the composition at the joining interface was analyzed using EDX.

Figure 14:
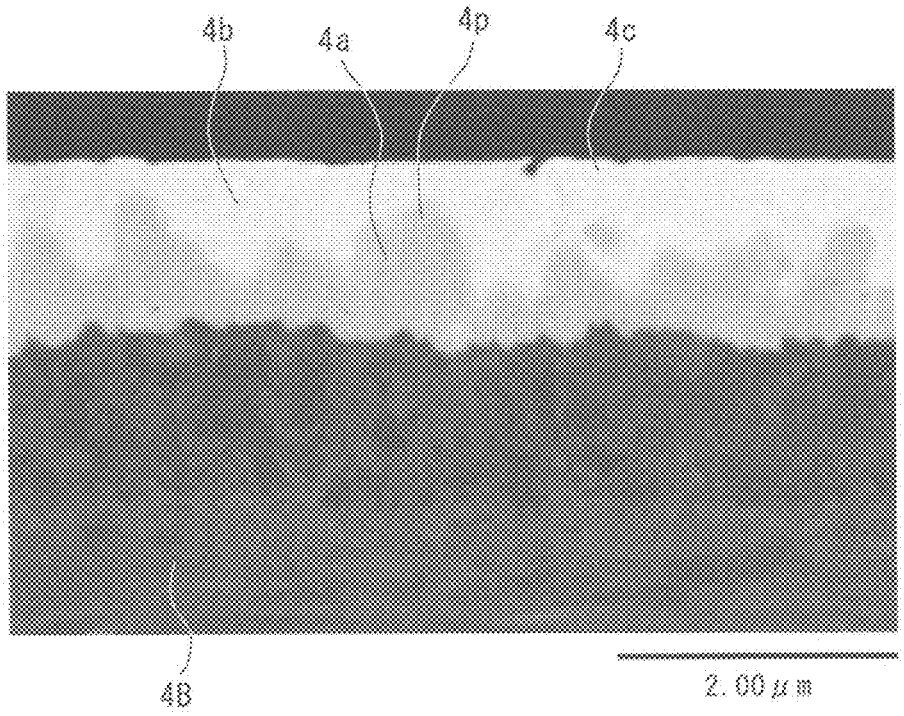
FIG. 14 is a diagram showing a SEM image of the cross section of a terminal described in Test Example 3.

FIG. 14 is a photograph showing the cross section of the grip portion 4B of the terminal 4 not yet connected to the conductor 20. In this terminal 4, the Sn layer 4*b* was formed on the surface of a Ni base material. The surface of the grip portion 4B is located on the upper side of the diagram. The dark gray portion on the lower side of the diagram corresponds to the Ni base material, and the second darkest gray portion formed on the Ni base material corresponds to the Sn—Ni alloy layer 4*a*. The Sn—Ni alloy was $Ni_3Sn_4$. The surface of the Sn—Ni alloy layer 4*a* had an irregular shape that included locally protruding protrusions 4*p*. In this example, reflow processing was performed after the Sn layer 4*b* was formed, and the protrusions 4*p* of the Sn—Ni alloy layer 4*a* were formed through this reflow processing. The pale gray portion formed on the Sn—Ni alloy layer 4*a* corresponds to the Sn layer 4*b*. The oxide coating 4*c* formed through natural oxidation of Sn was formed on the surface of the Sn layer 4*b*.

Figure 15:
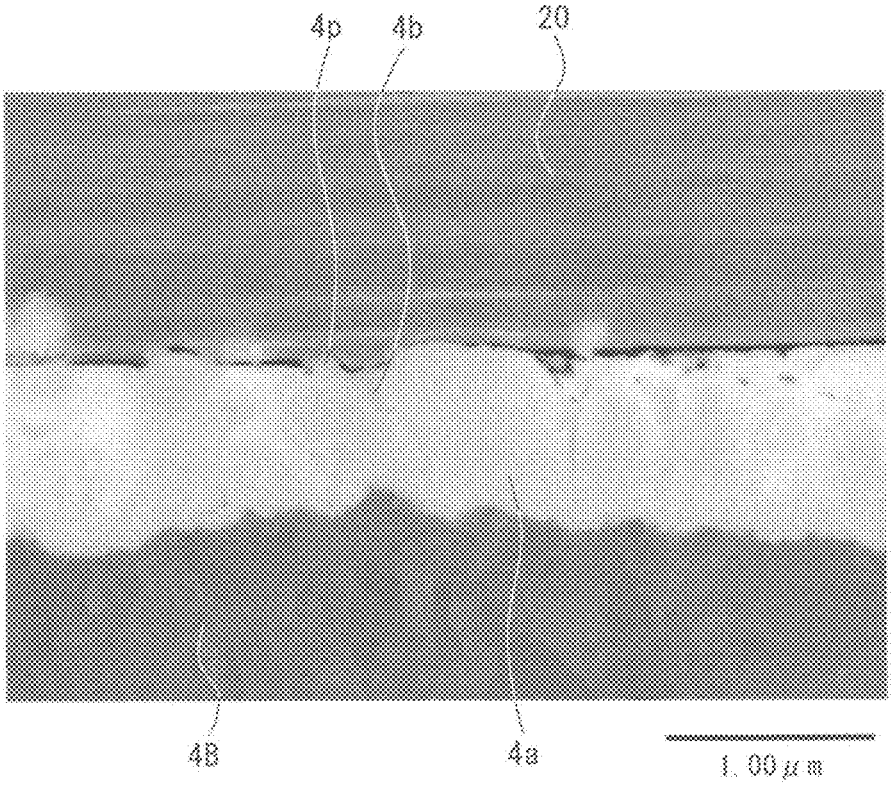
FIG. 15 is a diagram showing a SEM image of the cross section of a sample described in Test Example 3 taken immediately after the sample was produced.

FIG. 15 is a photograph showing the cross section of the joining interface taken immediately after the conductor 20 and the grip portion 4B were joined together. The gray portion located on the upper side of the diagram corresponds to the conductor 20. A Cu—Ag alloy provided with no Sn plating was used for the conductor 20 in this example. In this example, the conductor 20 was pinched by the grip portion 4B with a strong force, and therefore, the Sn layer 4*b* spread in the planar direction and thus became thin. At this time, the oxide coating 4*c* (FIG. 9) of the Sn layer 4*b* was broken, and Sn contained in the Sn layer 4*b* poured out onto the conductor 20 and adhered to the conductor 20. As previously described, Sn adhering to the conductor 20 (adhering portion 9 in FIG. 9) contributes to the increase in the conductor 20 holding force. Also, the protrusion 4*p* of the Sn—Ni alloy layer 4*a* passed through the Sn layer 4*b* that had become thin, and bit into the surface of the conductor 20. This bite serves as a mechanical hook. Accordingly, it is inferred that this bite contributes to the increase in the conductor 20 holding force.

Figure 16:
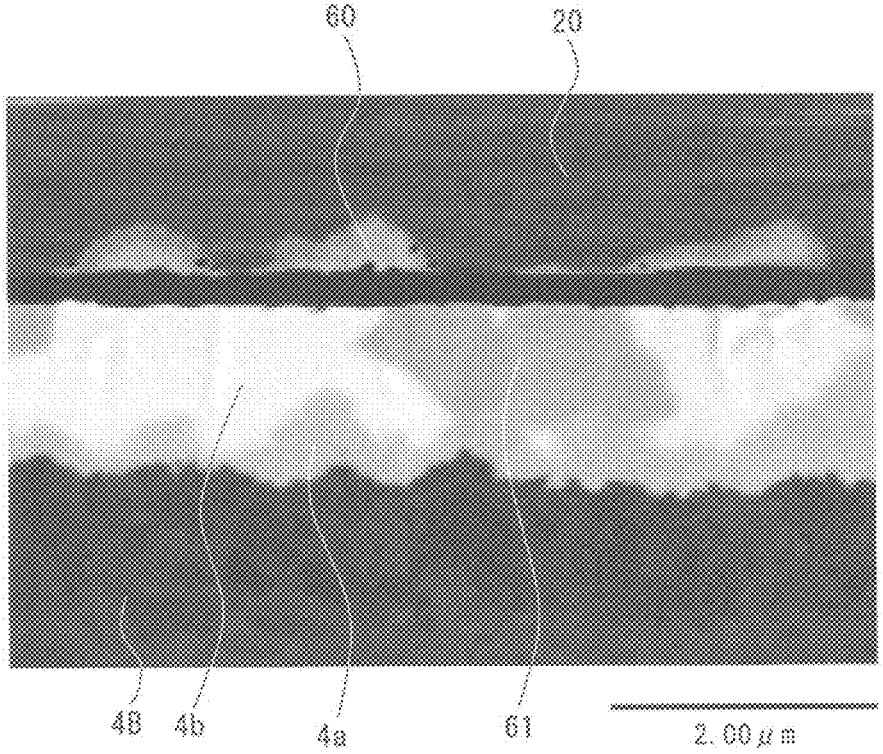
FIG. 16 is a diagram showing a SEM image of the cross section of a sample described in Test Example 3 taken after the sample was kept at a high temperature for a short period of time.

FIG. 16 is a photograph showing the cross section of the sample taken after the sample had been subjected to an accelerated test in which a produced sample is kept at 120° C. for 20 hours. In this photograph of the cross section, the pale gray portion is formed on the surface of the conductor 20. This pale gray portion corresponds to the Cu—Sn alloy layer 60. The Cu—Sn alloy layer 60 was formed through a reaction of Sn, which had adhered to the surface of the conductor 20, with Cu contained in the conductor 20. Also, the mixed layer 61 in which unreacted Sn, a Cu—Sn alloy, and a Sn—Ni alloy were mixed together was formed between the Cu—Sn alloy layer 60 and the Sn—Ni alloy layer 4*a*.

Figure 17:
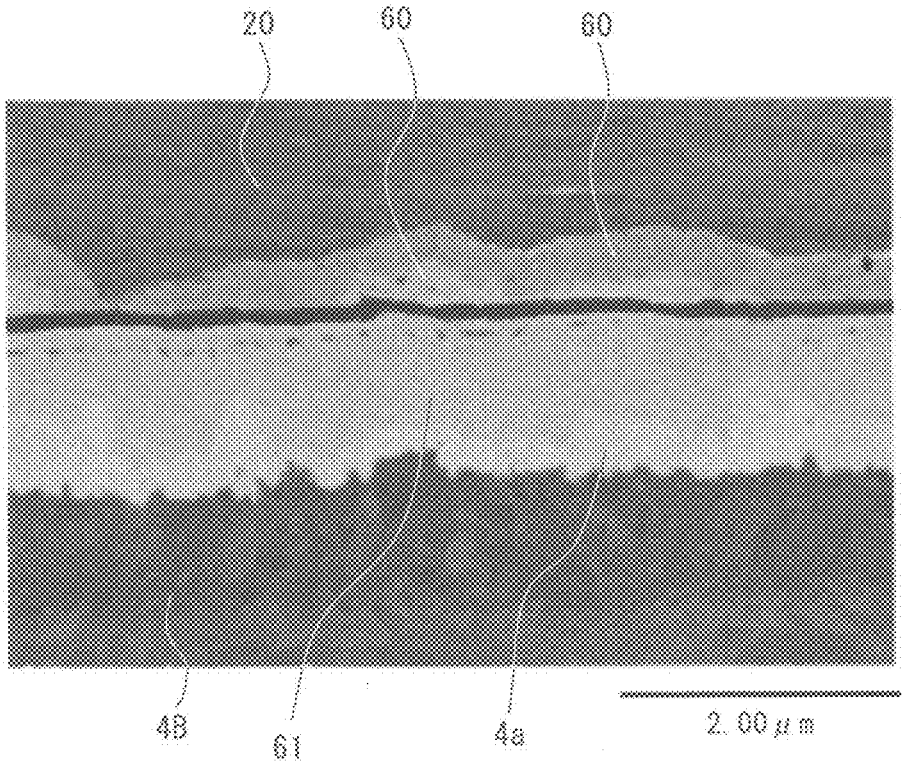
FIG. 17 is a diagram showing a SEM image of the cross section of a sample described in Test Example 3 taken after the sample was kept at a high temperature for a long period of time.

FIG. 17 is a photograph showing the cross section of the sample taken after the sample had been subjected to an accelerated test in which a produced sample is kept at 120° C. for 120 hours. In this photograph of the cross section, the mixed layer 61 is formed between the Cu—Sn alloy layer 60 and the Sn—Ni alloy layer 4*a*, and unreacted Sn is not present. In the mixed layer 61, the dark gray portion close to the conductor 20 was made of a $Cu_3Sn$ alloy, and the pale gray portion close to the grip portion 4B was made of $Cu_6Sn_5$.

It was found from the results above that Sn that adhered to the surface of the conductor 20 from the grip portion 4B formed an alloy over time.

LIST OF REFERENCE NUMERALS

1 Connector assembly
10 Terminal-equipped electric wire
2 Electric wire
20 Conductor
21 Insulating layer
3 Connector
3A Front housing
3B Rear cover
30 Insertion hole
31 Housing-side engagement portion
32 Cover-side engagement portion
31*f* First protrusion
31*s* Second protrusion
33 Partition wall
34 Cavity
35 Sliding groove
36 Through window
4 Terminal
4*a* Sn—Ni alloy layer
4*b* Sn layer
4*c* Oxide coating
4*p* Protrusion
4A Terminal connection portion
4B Grip portion
40 Insertion hole
41 First plate-like piece
42 Second plate-like piece
44 Serration
45 Terminal-side engagement portion
46 Through window
410 First thin portion
411 First thick portion
420 Second thin portion
421 Second thick portion
5 Shell
50 Tubular portion
50C Pressing portion
50*d* Step portion
51 First protruding portion
52 Second protruding portion
53 Guide portion
55 Shell-side engagement portion
55*f* First engagement portion
55*s* Second engagement portion
6 Alloy layer

60 Cu—Sn alloy layer
61 Mixed layer
7 Testing device
70 Pressing member
71 Chuck
8 Testing device
80 Base
82 Plate material
84 Sliding member
84*e* Embossing portion
9 Adhering portion

The invention claimed is:

1. A terminal-equipped electric wire comprising:
an electric wire that includes a conductor;
a terminal connected to the conductor; and
a shell attached to the terminal,
wherein the conductor has a nominal cross-sectional area of 0.13 $mm^2$ or less,
the terminal includes a grip portion that pinches the conductor,
the shell includes a pressing portion that presses at least a portion of the grip portion toward the conductor,
at least one of the conductor and the grip portion includes:
a tin layer;
an oxide coating formed on a surface of the tin layer; and
an adhering portion formed of a portion of tin contained in the tin layer that passes through the oxide coating and pours out onto a surface of the oxide coating, and
the adhering portion has an area of 0.100 $mm^2$ or more.

2. The terminal-equipped electric wire according to claim 1,
wherein the terminal includes the tin layer, and
the adhering portion adheres to the conductor.

3. The terminal-equipped electric wire according to claim 1,
wherein the conductor is a single-core wire.

4. The terminal-equipped electric wire according to claim 1,
wherein the conductor is made of a Cu—Sn alloy or a Cu—Ag alloy.

5. The terminal-equipped electric wire according to claim 1,
wherein the shell includes:
a tubular portion in which the grip portion is housed; and
the pressing portion formed in the tubular portion.

6. The terminal-equipped electric wire according to claim 5,
wherein the grip portion includes a first plate-like piece and a second plate-like piece that are opposed to each other with the conductor being located therebetween,
the pressing portion includes a first protruding portion and a second protruding portion that protrude toward an inner side of the tubular portion,
the first protruding portion presses the first plate-like piece toward the second plate-like piece, and
the second protruding portion presses the second plate-like piece toward the first plate-like piece.

* * * * *